United States Patent [19]

Donahue

[11] Patent Number: 4,766,616

[45] Date of Patent: Aug. 30, 1988

[54] LOCKING SAFETY HELMET

[76] Inventor: John P. Donahue, 63 Eliot Rd., Arlington, Mass. 02174

[21] Appl. No.: 32,608

[22] Filed: Apr. 1, 1987

[51] Int. Cl.[4] ..... A42B 3/02

[52] U.S. Cl. ..... 2/422; 70/59

[58] Field of Search ..... 70/59, 18, 58; 248/553, 248/551, 552; 2/422, 410

[56] References Cited

U.S. PATENT DOCUMENTS 3,436,936 4/1969 Locker ..... 70/59
4,024,738 5/1977 Pi .
4,676,080 6/1987 Schwarz ..... 70/59

FOREIGN PATENT DOCUMENTS 2376783 8/1978 France ..... 2/422

*Primary Examiner*—Peter Nerbun
*Attorney, Agent, or Firm*—Joseph S. Iandiorio; Douglas E. Denninger

[57] ABSTRACT

A locking safety helmet including a helmet; a retractable shackle; locking means for locking the shackle to the helmet in the locking position; and storage means included with the helmet for storing the shackle out of the way in the retracted position for conventional wearing of the helmet.

2 Claims, 3 Drawing Sheets

10
24
20
12
14
16
22
26
18

LOCKING SAFETY HELMET

FIELD OF INVENTION

This invention relates to a locking safety helmet which protects the head of the wearer in one mode and in a second mode locks the helmet to secure both the helmet and/or a bicycle or motorcycle.

BACKGROUND OF INVENTION

Safety helmets are a minor inconvenience to most when balanced against the prevention of serious head injuries. Such helmets, however, are an added burden to bicyclists and motorcyclists, for there is no place to put them when the ride is over. The cyclist can take the helmet with him, but that is awkward at best and not always possible. If the helmet is left with the cycle chances are high that the helmet will be stolen. A second problem is the security of the cycle itself. If that is not secured the chances are also very high that it too will be stolen. Attempts to solve these problems have included a helmet having ear flaps with holes for receiving a chain. However, there is no place provided to store the chain when the helmet is being worn and the two can easily become separated. Further, there must be provided a lock, either on the chain or separately. In another approach the chin strap of the helmet is separable and lockable with the rest of the helmet. This structure may permit the helmet to be secured but is not well suited to securing the cycle as well.

SUMMARY OF INVENTION

It is therefore an object of this invention to provide an improved simple, inexpensive and extremely convenient locking safety helmet.

It is a further object of this invention to provide such a locking safety helmet which carries all the locking elements as a single unit with the helmet.

It is a further object of this invention to provide such a locking safety helmet in which the helmet forms part of the locking mechanism.

It is a further object of this invention to provide such a locking safety helmet which has an independent shackle portion which is carried by the helmet but is retractable out of the way when the helmet is to be worn.

The invention results from the realization that a truly effective and convenient locking safety helmet can be achieved by providing the helmet as an integral part of the locking mechanism but with a separate shackle which is independent of the helmet in its normal safety function yet is carried by the helmet.

This invention features a locking safety helmet including a helmet and a retractable shackle. There are locking means for locking the shackle to the helmet in the locking position and storage means included with the helmet for storing the shackle out of the way in the retracted position for conventional wearing of the helmet.

In a preferred embodiment the locking means may include at least one lock mechanism and it may be in the helmet and the shackle may be a rod. There may be two lock mechanisms used for securing each end of the shackle to the helmet. The shackle may be curved with a curve similar to that of the helmet for ease of storage in the retracted position. The storage means may include a compartment in the helmet for receiving the shackle in the retracted position; the compartment could be shaped or curved to accomodate the shape or curve of the shackle. The storage means may also include on the helmet some means for securing the shackle in the retracted position.

DISCLOSURE OF PREFERRED EMBODIMENT

Other objects, features and advantages will occur from the following description of a preferred embodiment and the accompanying drawings, in which.

The locking safety helmet of this invention may be accomplished using a helmet and a retractable shackle. The helmet is of generally conventional design except that it has storage means included in the helmet for storing the shackle out of the way in the retracted position for conventional wearing of the helmet. There are locking means for locking the shackle to the helmet in the locking position. The locking means includes at least one lock mechanism and the lock mechanism is preferably on or in the helmet. There may be two lock mechanisms, one for securing each end of the shackle to the helmet. The shackle may be a rod, but could also be a chain or cable. The shackle is preferably curved as a conventional lock shackle is curved, but may as well be specifically curved similar to the curve in the helmet for ease of storage in the retracted position. The storage means may include a compartment in the helmet for receiving the shackle in the retracted position, in which case the compartment too would be shaped or curved similarly to the shackle. A break or gap in the compartment may be provided for gripping the shackle in the retracted position and moving it to the extended position. The storage means may also include on the helmet some means for securing the shackle in the retracted position. This may be for example a snap-fit channel which can be on the inside or on the outside portion of the helmet such as the brim.

Figure 1:
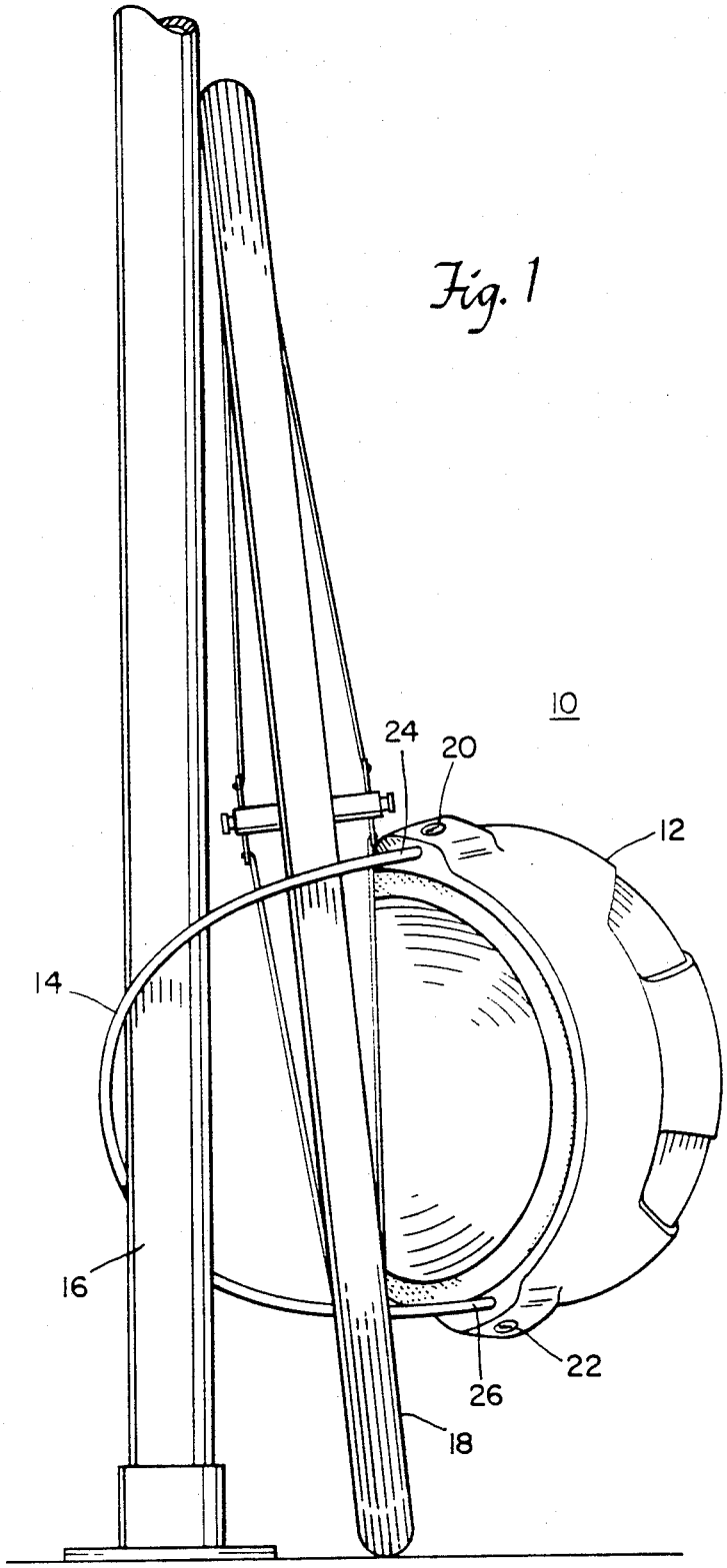
FIG. 1 is a perspective view showing the locking safety helmet of this invention with the shackle in the extended locking position and the locking safety helmet being used in the locking mode to lock a bicycle to a permanent fixed post.

There is shown in FIG. 1 a locking safety helmet 10 according to this invention including a helmet 12 and shackle 14. Helmet 12 is a cycler's safety helmet of generally conventional construction except for the modifications indicated by the invention. Shackle 14 is a curved steel rod. Shackle 14 is passed around a permanent fixed post 16 and a portion of the wheel or frame 18 of a bicycle. It is secured to helmet 12 by means of locking mechanisms 20 and 22 mounted in helmet 12 to receive the two ends 24 and 26 of shackle 14. In this way the helmet 12 is safely secured to post 16 while at the same time securing bicycle part 18 and the entire associated bicycle as well. When locking safety helmet 10 is to be removed from this locking position or locking mode, it is only necessary to operate locks 20 and 22 using the correct key or combination to free shackle 14 from helmet 12.

Figure 2:
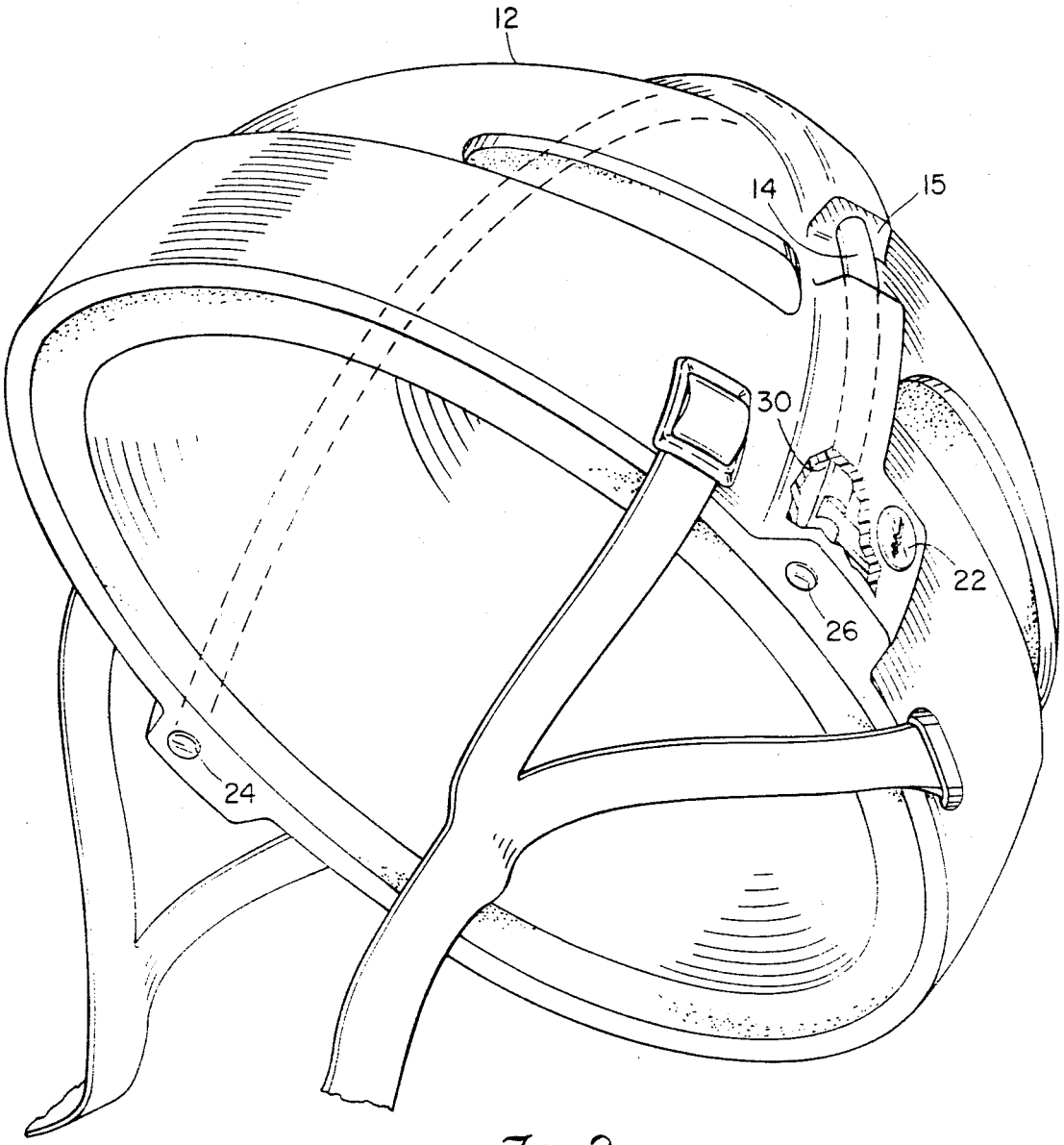
FIG. 2 is a perspective view of the helmet of FIG. 1 with the shackle stored in a compartment in the helmet.

Then for conventional use, shackle 14, FIG. 2, is retracted into compartment 30 built in to helmet 12.

One or both locking mechanisms may be once again actuated to secure shackle 14 in the compartment. Gap 15 is provided for gripping shackle 14 and initiating its extension from compartment 30.

Figure 3:
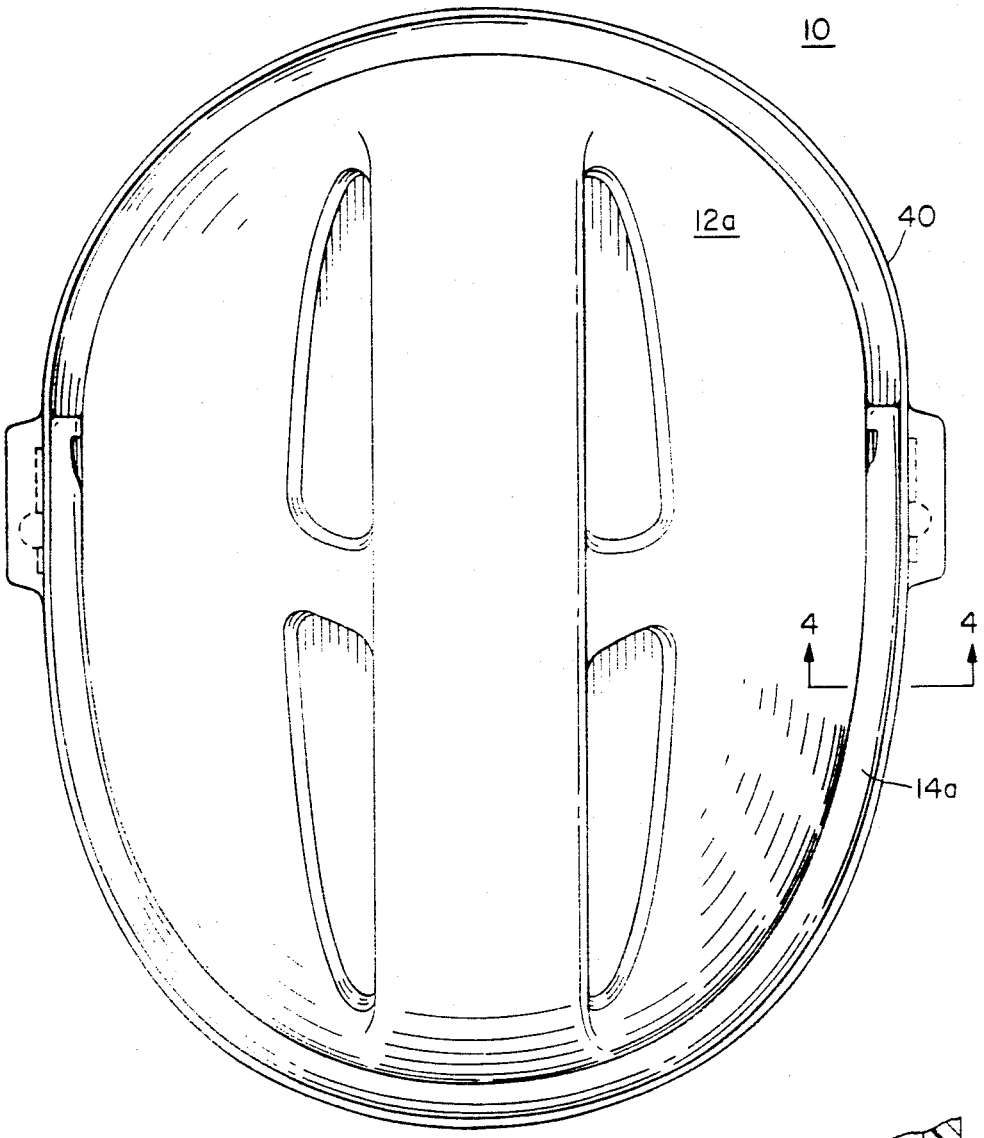
FIG. 3 is a top plan view of the helmet showing the shackle alternately stored in a snap-fit channel on the brim of the helmet.
Figure 4:
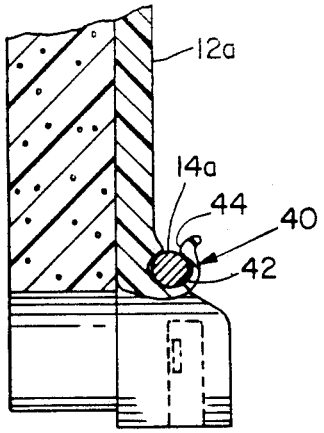
FIG. 4 is a cross-sectional view taken along lines 4—4 of FIG. 3.

Shackle 14 need not be stored in a compartment in helmet 12. For example, as shown in FIG. 3, shackle 14*a* may be stored on the outside of helmet 12*a* on its brim 40 as shown including a snap-fit channel 42, FIG. 4, in which the opening 44 is slightly narrower than the remainder of the channel and the rod 14*a*, so that once rod 14*a* is snapped past portion 44 it rests in channel 42 without a tendency to pop out.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A locking safety helmet comprising:

a helmet;

a curved shackle having a retracted position on the helmet;

locking means for locking said shackle to said helmet in a locking position; and storage means including a compartment in said helmet curved similarly to said shackle for storing said shackle in the retracted position, said shackle, in its retracted position, not interfering with the wearer's head when the helmet is worn.

2. The safety helmet of claim 1 in which said locking means includes two lock mechanisms, one for securing each end of the shackle to the helmet in the locking position.

* * * * *